United States Patent [19]

Sellwood

[11] 4,141,297

[45] Feb. 27, 1979

[54] IGNITION CIRCUITS

[75] Inventor: Raymond E. Sellwood, Slough, England

[73] Assignee: M.L. Aviation Company Limited, Slough, United Kingdom

[21] Appl. No.: 791,873

[22] Filed: Apr. 28, 1977

[30] Foreign Application Priority Data

May 4, 1976 [GB] United Kingdom ..... 18195/76

[51] Int. Cl.[2] ..... F42C 11/00

[52] U.S. Cl. ..... 102/206; 361/248

[58] Field of Search ..... 102/70.2 R, 70.2 G, 102/70.2 A; 89/1 B, 1.5 E, 1.5 F; 361/248

[56] References Cited

U.S. PATENT DOCUMENTS

| | | | |
|---|---|---|---|
| 2,976,485 | 3/1961 | Bartz | 102/70.2 R |
| 3,045,148 | 7/1962 | McNulty et al. | 102/70.2 R |
| 3,255,366 | 6/1966 | McNulty et al. | 102/70.2 R |
| 3,288,068 | 11/1966 | Jefferson et al. | 102/70.2 A |

FOREIGN PATENT DOCUMENTS

| | | | |
|---|---|---|---|
| 1235844 | 6/1971 | United Kingdom | 89/1.5 F |

*Primary Examiner*—Charles T. Jordan

*Attorney, Agent, or Firm*—Kemon & Estabrook

[57] ABSTRACT

This invention relates to an ignition circuit assembly for an explosive device of the kind in which an electric heating element is energizable from a transformer secondary winding to ignite the explosive. A transformer primary winding, which in use is magnetically coupled to the secondary winding, is contained in a casing, together with a generator circuit which is operable to energize the primary winding and an inhibiting circuit which inhibits operation of the generator circuit until a trigger signal is applied to the inhibiting circuit to cancel the inhibition.

10 Claims, 5 Drawing Figures

IGNITION CIRCUITS

This invention relates to ignition circuits for explosive devices, the devices being of the kind having an electrically-energised heating element for igniting the explosive.

Such explosive devices are commonly used for actuating or releasing mechanisms, such as, for example, ejector release mechanisms in aircraft. It is, of course, absolutely essential that such mechanisms shall fire only in response to a properly-applied command signal, and shall not, under any circumstances, fire as a result of the application of spurious signals. Spurious signals in the form of radio frequency oscillations are often present in aircraft and in other situations, such as in ships and in other vehicles, where the explosive devices are used. Precautions must be taken to ensure that the spurious signals do not cause triggering of the ignition circuit, and do not themselves supply sufficient energy to the explosive device to cause ignition. The safety arrangements have generally added considerably to the size, weight and expense of the ignition equipment.

However, in our British patent specification No. 1,235,844 there is disclosed an improved ignition circuit in which the explosive device comprises, besides the explosive charge, an electrical heating element for igniting the charge and a first coil connected to the element and wound on a magnetic core. The device is received by a holder which contains a second coil which is wound on a second magnetic core and which becomes inductively linked with the first coil by proximity of the two cores, so that energisation of the second coil by an oscillator induces a current in the first coil which energises the heating element and ignites the charge. The cores are preferably pot cores which completely enclose the coils and thereby shield them from spurious radio frequency signals. In order to initiate firing of the charge, the oscillator is energised by merely feeding a d.c. supply to the oscillator.

In the present invention, an ignitor circuit is similarly magnetically coupled to an electrical heating element, but mere connection of the d.c. supply does not initiate the ignitor circuit because oscillation of the oscillator is inhibited until action is taken to cancel the inhibition.

The oscillator preferably comprises a self-exciting saturating core bridge circuit, each limb of which contains a transistor or other switching device, at least one of the switching devices being held non-conductive to inhibit oscillation of the circuit.

Figure 1:
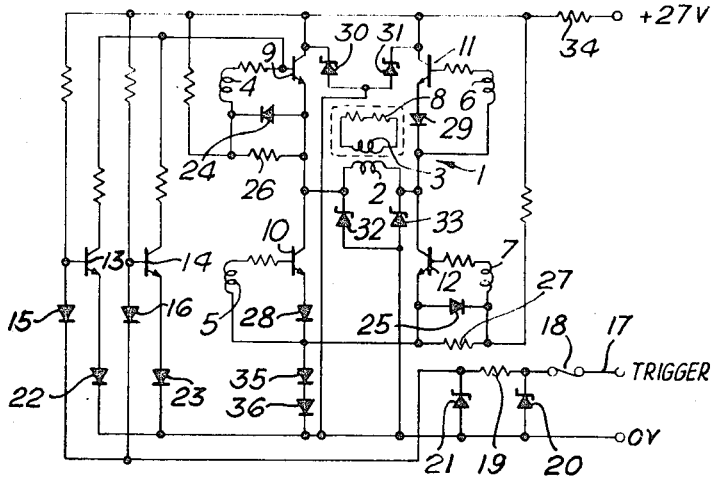
Figure 2:
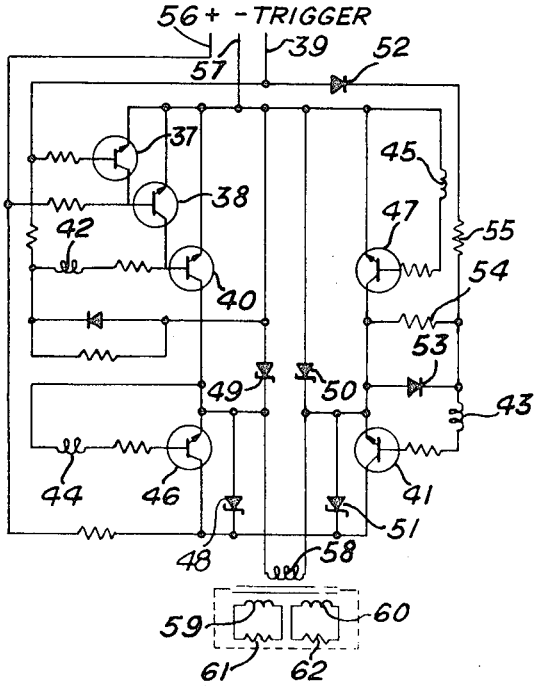
Figure 3:
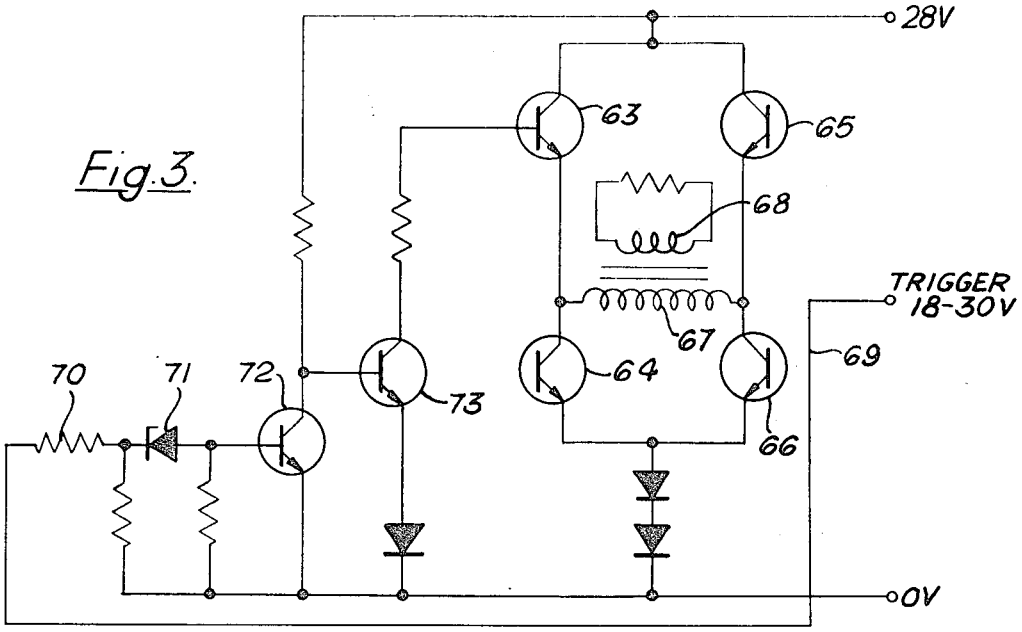
Figure 4:
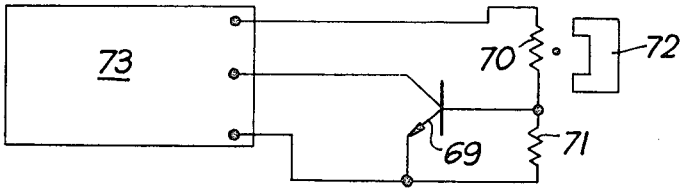
Figure 5:
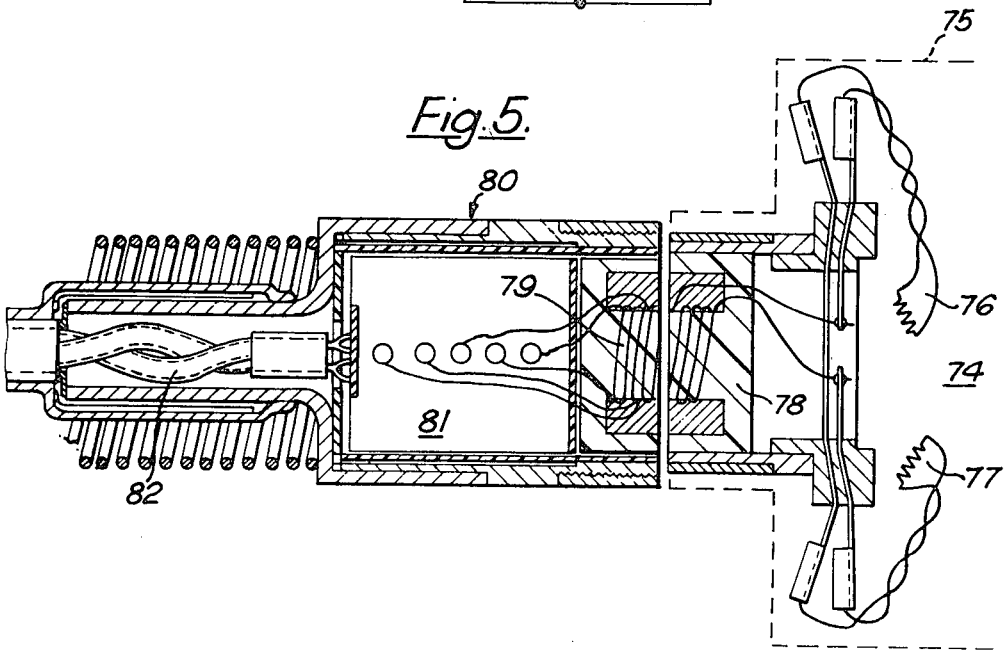

Embodiments of the invention will now be described, by way of example, with reference to the accompanying drawings, in which:

FIG. 1 is a diagram of one configuration of an ignition circuit in accordance with the invention, FIG. 2 is a diagram of another ignition circuit configuration, FIGS. 3 and 4 are diagrams of alternative inhibit circuits for use in the ignition circuits, and FIG. 5 is a longitudinal cross-section through a combination of an explosive device and an ignition circuit in accordance with the invention.

Referring to FIG. 1, a saturable ferrite core transformer 1 has a primary winding 2, a secondary winding 3 and four tertiary windings 4–7, respectively. The secondary winding 3 is connected to a heating element 8 of an explosive fuse, and the primary winding 2 is connected to the output points of a transistor bridge inverter comprising transistors 9–12. Each tertiary winding is connected to the base electrode of a respective one of the transistors, the windings being suitably phased for selfexcitation of the bridge circuit so that it oscillates, thereby producing a square wave output of, say, 20/50 KHz at the secondary winding 3. The ratio of secondary turns to primary turns is chosen to give the level of output current required for igniting the particular explosive device which is being used.

Until ignition of the explosive device is required, oscillation of the circuit is inhibited by transistors 13 and 14, the collector electrodes of which are connected to the base electrode of the transistor 9. The base electrodes of the transistors 13 and 14 are connected through diodes 15 and 16 to a trigger line 17. The trigger line 17 is open-circuit or is normally at a "high" level, which may be, for example, at least 2.7 volts positive if the trigger line is fed from transistor/transistor logic (TTL). This voltage level holds the transistors 13 and 14 conductive, so that the base of the transistor 9 is negative with respect to its emitter and this transistor is, therefore, cut off. Oscillation of the bridge circuit is therefore inhibited. An overvoltage and surge suppression network comprising a fuse 18, a resistor 19 and zener diodes 20 and 21 is connected to the trigger line 17.

If a "low" voltage level (e.g. no greater than 0.4 volts positive for a TTL "0" state) is now fed to the trigger line, the transistors 13 and 14 will be cut off and the base voltage of the transistor 9 will rise. The bridge circuit will start to oscillate, and the explosive will be ignited.

The diodes 15 and 16 prevent too large a positive voltage from being fed to the base electrodes of the transistors 13 and 14 from the trigger line 17, and diodes 22 and 23 compensate for the forward voltage drop across the diodes 15 and 16 when the trigger input is in the "low" state. Diodes 24 and 25, when conductive, provide low resistance shunts across resistors 26 and 27, respectively, in the biasing circuits of the transistors 9 and 12, respectively. Diodes 28 and 29 are provided in the base/emitter circuits of the transistors 10 and 11, respectively, so that all of the bridge transistors have substantially identical resistor/coil/diode base-to-emitter configurations. Zener diodes 30 to 33 and a resistor 34 protect the transistors from transient over-voltages appearing on the 27 volt d.c. supply line. Diodes 35 and 36 carry the current flow from the bridge when it is oscillating. The voltage drop across those diodes is effectively applied to the base electrode of the transistor 9 to maintain oscillation despite removal of the trigger signal.

Since both of the transistors 13 and 14 conduct hard as soon as the d.c. supply is connected to the circuit (assuming a "high" level is present on the trigger line), spurious positive-going signals applied to the trigger or supply lines will only cause the transistors 13 and 14 to bottom harder, and the impedance to negative-going radio frequency signals will be low. Furthermore, the inhibiting circuit will ignore pulses of less than 5 $\mu$ secs width, whatever their polarity or amplitude, so that spurious operation of the circuit due to normal induced transients is avoided.

Failure of one of the transistors 13 or 14 will not cause cancellation of the oscillation inhibit, since the other transistor 14 or 13 will still have a "high" input and will still be conductive and so will hold down the base of the transistor 9. Hence, the provision of the transistors 13 and 14 effectively in parallel increases the safety of the circuit.

The trigger line signals are at quite low energy levels, so they can be supplied or controlled by low-power circuitry, whereas the previously proposed circuit in which the power supply to the oscillator was switched on to initiate ignition required a relatively high-power switching device.

Several advantages are gained by using the above-described bridge inverter circuit. Firstly, although the presence of radiation in some environmental conditions might cause all of the transistors 9 to 12 to conduct simultaneously, the bridge is balanced (or nearly balanced) so that any output voltage from the transformer secondary winding 3 would be minimal. Secondly, the transistors 9 to 12 switch in one half-cycle to a cut off state and in the next half-cycle to a saturated state, so that dissipation in the transistors is minimal. Thirdly, no timing elements are required, since the timing is determined by saturation of the transformer core.

Referring to FIG. 2 of the drawings, in a modified form of inhibiting circuit transistors 37 and 38 are connected together in a high-gain switching circuit. A single trigger line 39 provides a base drive signal to transistors 37, 40 and 41. In the absence of any trigger input, the transistor 37 is cut off, so that any signal induced in the base circuit of the transistor 40 will cause the transistor 38 to conduct, thereby holding off the transistor 40 and inhibiting oscillation. Only whilst a trigger signal is applied to the transistor 37 can the circuit oscillate to cause ignition of the explosive.

The trigger signal turns on the transistors 37, 40 and 41, the transistor 38 being held inoperative by conduction of the transistor 37. Tertiary windings 42 and 43 connected to the bases of the transistors 40 and 41, respectively, are so phased as to cause those transistors to conduct harder, and rapidly to saturate. The core magnetisation current then increases rapidly so that those transistors rapidly come out of saturation. The collector current becomes constant, so that no feedback voltage is induced in the tertiary windings. The collector current then falls to zero, thereby inducing signals in tertiary windings 44 and 45, which turn on the transistors 46 and 47. The cyclic operation continues with the diagonally opposite pairs of transistors of the bridge conducting alternately.

Zener diodes 48 to 51 protect the bridge transistors against inductive voltage spikes produced as the transistors switch on and off. A diode 52 prevents current from flowing via a diode 53, a resistor 54 and a resistor 55, which would otherwise maintain the trigger condition after the trigger signal ceases.

The circuit is energised from positive and negative lines 56 and 57, respectively, from an 18–28 volt d.c. supply.

The transformer has similar characteristics to that in FIG. 1, and has a primary winding 58; two secondary windings 59 and 60, each connected to a respective fuse heating element 61 and 62; and the four tertiary windings 42–45 mentioned above.

An alternative circuit is shown in FIG. 3, from which the base drive circuits of bridge transistors 63–66 have been omitted. These drive circuits can be similar to those of FIG. 1 or FIG. 2. The transformer primary and secondary windings 67 and 68, respectively, are arranged as in FIG. 1.

In this circuit, the trigger voltage is applied via a line 69, a resistor 70, and a zener diode 71 to the base of a transistor 72 to cause the transistor to conduct. This lowers the potential of the base of a transistor 73, thereby switching off the transistor. This allows the base potential of the transistor 63 to rise so that the bridge oscillates.

In a further alternative circuit shown in FIG. 4, the base bias of an inhibit transistor 169 is controlled by a magnetoresistor element 170 connected in series with a resistor 171 to form a potential divider network. Application of a magnetic field to the element, for example by means of a magnet 172, or rotation of a magnetic field applied thereto, causes a change in the resistance of the element 170, thereby switching the inhibit transistor 169 on or off to control oscillation of an oscillator circuit 173 such as those described above. The rotation of the magnetic field can be effected by rotation of the magnet 172 by means of a suitable mechanism.

Any or all of the transistors in the circuits described above can be of the leadless inverted type bonded to a thick film circuit formed on an alumina substrate together with the other necessary components.

FIG. 5 shows an example of a practical configuration of an assembled explosive device and control circuit in accordance with the invention. The explosive device 74 is contained within a casing 75 (only part of which is shown) and includes the igniter heating elements 76 and 77 connected to the transformer secondary winding 78 wound on a ferrite pot core. The secondary winding 78 may comprise turns of ferric oxide-coated acetate tape, which may be held in the wound configuration by adhesive or by forming under pressure and heat. The winding is preferably encapsulated in an epoxy resin. Each heating element may comprise a coil of insulated, low melting point metal or a coil of plated acetate material which, when energised, will be totally consumed, thereby minimising the effects of debris.

The transformer primary winding 79 and the tertiary windings are also encapsulated on a ferrite pot core contained within a casing 80 formed of an aluminium alloy, such as duralumin. The cores are arranged to be in axial alignment when the casing 80 is located relative to the device 74. The cores are separated only by cupro-nickel diaphragms which close the ends of the device 74 and the casing 80, respectively. The casing 80 is spring loaded to give firm abutment between the transformer primary and secondary assemblies.

Also contained within the casing 80 is an assembly 81 comprising the transistor bridge and the inhibit circuitry as described above. The assembly 81 may also be encapsulated in a synthetic resin. A cable 82 feeds a d.c. supply and the trigger signal to the assembly 81.

It may be advantageous in some instances if radiation effects, particularly Gamma radiation, cause operation of the oscillator. For instance, in the event of a nuclear attack on a military vehicle or ship, the arrival of the radiation may be utilised to close watertight doors or panels against the later arrival of blast effects. Similarly, the Gamma radiation pulse may be utilised to operate the visor of a protective helmet, to protect personnel against the longer effects of infra-red radiation from the nuclear blast. A switching device may be arranged in the circuit to cancel the oscillation inhibit, on receipt of radiation, thereby causing operation of the ignition circuit to cause closing of the doors, operation of the visor, etc.

I claim:

1. An ignition circuit assembly for an explosive device of the kind having an electrically-energisable heating element for igniting the explosive device, and a transformer secondary winding connected to the heating element, the circuit assembly comprising, a transformer primary winding to be coupled magnetically to the secondary winding by proximity of the explosive device and the circuit assembly; a generator circuit operable to feed an electrical signal to the transformer primary winding for inducing in the transformer secondary winding an energising current for the heating element to cause ignition of the explosive device; and an inhibiting circuit to inhibit operation of the generator circuit until a trigger signal is applied to the inhibiting circuit to cancel the inhibition.

2. A circuit as claimed in claim 1, wherein the generator circuit comprises four transistors connected in a bridge inverter configuration.

3. A circuit as claimed in claim 2, wherein the generator circuit includes four tertiary windings magnetically coupled to the primary winding.

4. A circuit as claimed in claim 2, wherein the inhibiting circuit includes means for maintaining one of the bridge transistors non-conductive until application of the trigger signal.

5. A circuit as claimed in claim 4, wherein the means for maintaining one of the bridge transistors non-conductive comprises two transistors connected in parallel to provide redundancy in case of failure of one of said two transistors.

6. A circuit as claimed in claim 4, wherein the means for maintaining one of the bridge transistors non-conductive comprises two transistors connected in cascade as a highgain switch.

7. A circuit as claimed in claim 4, wherein the means for maintaining one of the bridge transistors non-conductive comprises an inhibit transistor; a magnetoresistor which controls the biasing of the inhibit transistor; and means operable to apply a magnetic field to the magnetoresistor to modify its resistance thereby changing the conductivity state of the inhibit transistor.

8. A circuit as claimed in claim 1, wherein the generator and inhibiting circuits are formed together as an integrated circuit.

9. A circuit as claimed in claim 1, wherein the primary winding is provided on a ferrite pot core which can be abutted and aligned, in use, with a ferrite pot core on which the secondary winding is provided.

10. An ignition circuit assembly as defined by claim 1 including a casing surrounding said circuit assembly.

* * * * *